US007543839B2

(12) United States Patent
Hartmann

(10) Patent No.: US 7,543,839 B2
(45) Date of Patent: Jun. 9, 2009

(54) SYSTEM FOR SKIS

(76) Inventor: Erik Hartmann, Fraenavegen 56B, N-6415, Molde (NO)

( * ) Notice: Subject to any disclaimer, the term of this patent is extended or adjusted under 35 U.S.C. 154(b) by 402 days.

(21) Appl. No.: 10/543,126

(22) PCT Filed: Jan. 21, 2004

(86) PCT No.: PCT/NO2004/000015

§ 371 (c)(1),
(2), (4) Date: Jul. 22, 2005

(87) PCT Pub. No.: WO2004/064949

PCT Pub. Date: Aug. 5, 2004

(65) Prior Publication Data

US 2006/0138747 A1 Jun. 29, 2006

(30) Foreign Application Priority Data

Jan. 24, 2003 (NO) ..... 20030380

(51) Int. Cl.
*A63C 7/04* (2006.01)

(52) U.S. Cl. ..... 280/604

(58) Field of Classification Search ..... 280/600, 280/601, 604, 610

See application file for complete search history.

(56) References Cited

U.S. PATENT DOCUMENTS 1,989,377 A * 1/1935 Osborn ..... 280/604
2,189,760 A * 2/1940 Dimi et al. ..... 280/604
3,178,194 A * 4/1965 Buchmuller ..... 280/604
4,564,210 A * 1/1986 Case ..... 280/604
4,666,178 A * 5/1987 Matthews ..... 208/604
5,221,104 A * 6/1993 Bejean et al. ..... 280/604
6,105,990 A * 8/2000 Sutherland ..... 280/604
6,471,234 B2 * 10/2002 Ayliffe ..... 280/604
6,659,492 B2 * 12/2003 Gousie ..... 280/604
6,837,512 B2 * 1/2005 Long ..... 280/604

FOREIGN PATENT DOCUMENTS

DE 3318259 A1 * 11/1984
FR 2792213 A1 * 10/2000

* cited by examiner

*Primary Examiner*—Christopher P Ellis
*Assistant Examiner*—John D Walters
(74) *Attorney, Agent, or Firm*—Dennison, Schultz & MacDonald

(57) ABSTRACT

A kick-enhancing system for a ski, including a band or strip which on one flat surface thereof is attachable to a portion of the ski sole by means of an adhesive, and which on the opposite side is equipped with a skin, a no-wax covering or a ski wax covering. Mounted in the ski is an engagement block which has at least one engaging hole able to engage with a retaining piece to which a forward portion of the band or strip is fastened, the retaining piece being equipped with at least one fastening lug for engagement in the engaging hole upon insertion from the underside of the ski.

12 Claims, 10 Drawing Sheets

SYSTEM FOR SKIS

This application is a filing under 35 USC 371 of PCT/NO2004/000015 filed Jan. 24, 2004.

BACKGROUND OF THE INVENTION

The present invention relates to a kick-enhancing system for skis, a device for affixing a kick-enhancing covering, and a kick-enhancing covering for skis.

It is already known to place a kick-enhancing skin under the ski or to use ski wax in the form of a hard wax or a klister wax.

When a person intends to ski without using the skating technique, it is essential that the ski should have a grip against the snow in the kick direction. One way in which to obtain kick grip on a touring ski is to apply grip wax or use a skin under the ski. A well-known problem associated with grip wax, whether it is a hard wax or a klister wax, is that it is difficult to match it to the temperature and snow conditions, especially when these parameters change constantly from day to day, and even from hour to hour because of the warming of the sun or because of altitude or the nature of the terrain. Often, a skier will find that the skiing conditions change as he moves up or down in the terrain. Low down, the skier generally encounters wet klister wax conditions, whilst higher up he finds dry grip wax conditions. The result is well known: it is necessary to rewax the skis, which is particularly problematic if klister must be removed in order to apply a harder wax.

It is known that under certain competition conditions skiers have used a tape provided in part with a ski wax covering which was glued to the underside of the ski along the whole of its length, and which, when the ski wax was no longer effective under the prevailing snow conditions in the ski track, was peeled off to uncover a second wax under the tape or to allow the application of a ski wax which was more suitable for the prevailing conditions. Although such a solution per se was regarded as fascinating, it proved to be rather impractical in general.

An alternative solution has therefore been to use so-called "no-wax" skis, i.e., a type of fish scale-like pattern on the sole of the ski. Quite apart from the fact that such skis generate a certain amount of noise under some conditions, it is known that skis of this type are not immediately suitable for the endless, varying track conditions encountered during a trip.

Another known solution for obtaining satisfactory grip under changing conditions has been to use skins of synthetic fibres or sealskin under the ski essentially along the whole length of the ski, these skins having had an almost fur-like structure. Such skins can be found in a multitude of varieties. Skins of this kind give a good grip in most snow and temperature conditions, but the disadvantage is that the glide is considerably reduced, in particular because with the known attachment systems the skin must extend right up to the tip of the ski, or a strap must be fastened around the ski. Naturally, this may be found to be a problem in normal touring use where the terrain changes constantly from uphill to downhill. Today's known skin solutions also greatly reduce both the running and steering characteristics of the ski. The reason is of course that the skin fabric per se, as indicated above, has a detrimental effect on the characteristics of the ski, not least the gliding characteristics, but also because of the way such skins are attached to the underside of the ski. The known attachment systems are all located on the actual skin unit, i.e. not on the ski itself. Some of the existing attachment methods mean that the skier must ski with more skin fabric than necessary in order to obtain sufficient kick grip.

SUMMARY OF THE INVENTION

Accordingly, one of the tasks of the present invention has been to provide a system, a device and a covering for skis as mentioned above, where these means are intended to help overcome at least to a large extent the aforementioned disadvantages.

According to the invention, the aforementioned system, fixing device, and kick-enhancing covering are characterised by the features set forth hereinbelow

BRIEF DESCRIPTION OF THE DRAWINGS

The invention will now be described in more detail with reference to the attached figures which show exemplary embodiments that are non-limiting for the invention.

DESCRIPTION OF PREFERRED EMBODIMENTS

Figure 1:
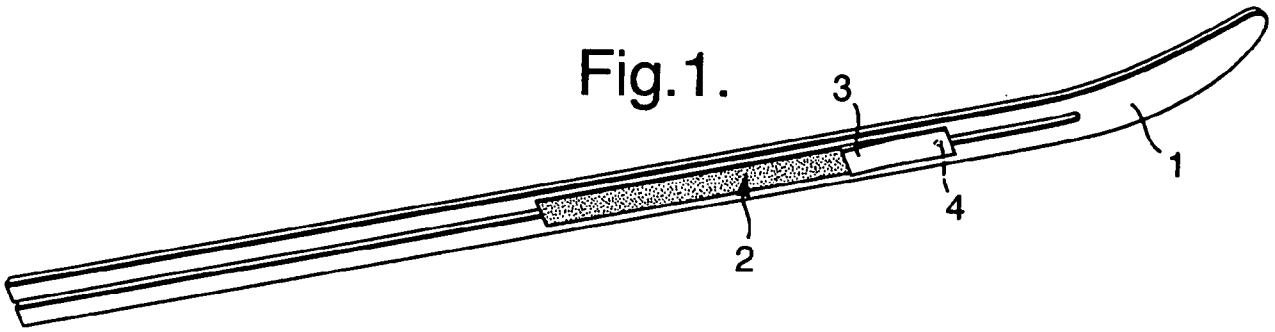
FIG. 1 shows a ski with the system, device and covering according to the invention.
Figure 2:
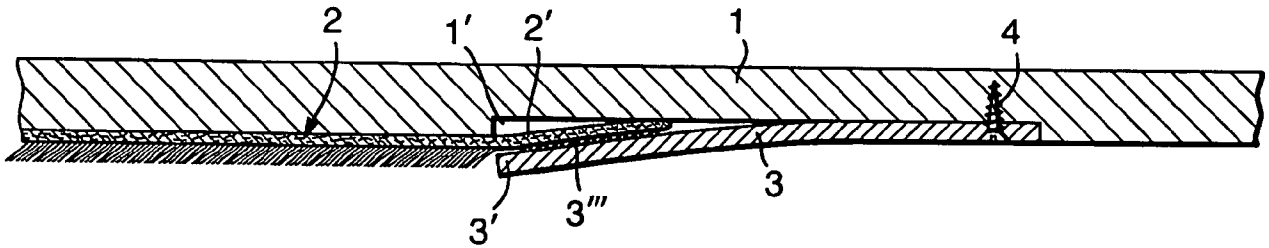
FIG. 2 is an enlarged cross-sectional view of a part of the system according to the invention.
Figure 3:
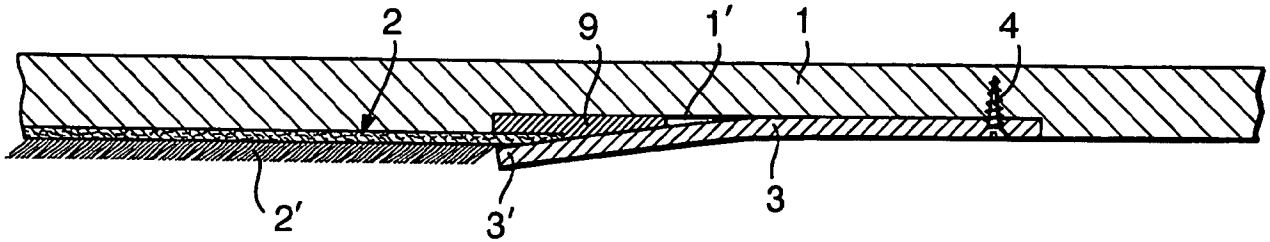
FIG. 3 shows a variant of the system shown in FIG. 2.
Figure 4:
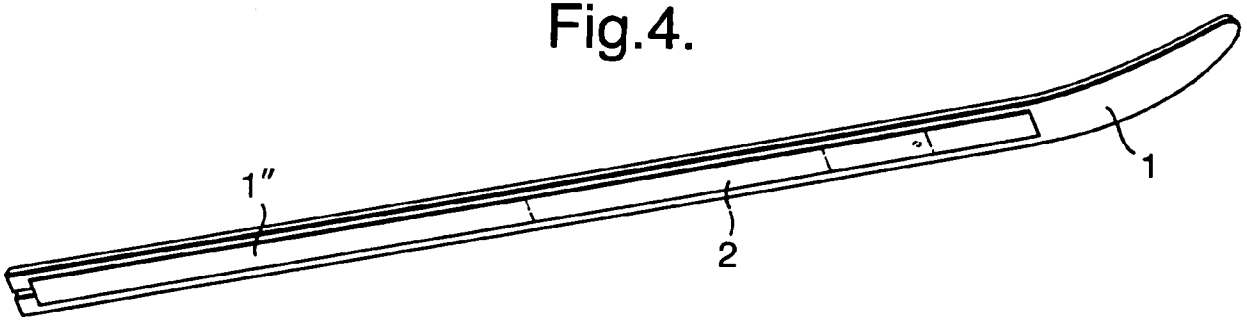
FIG. 4 shows a variant of the embodiment in FIG. 1.
Figure 5:
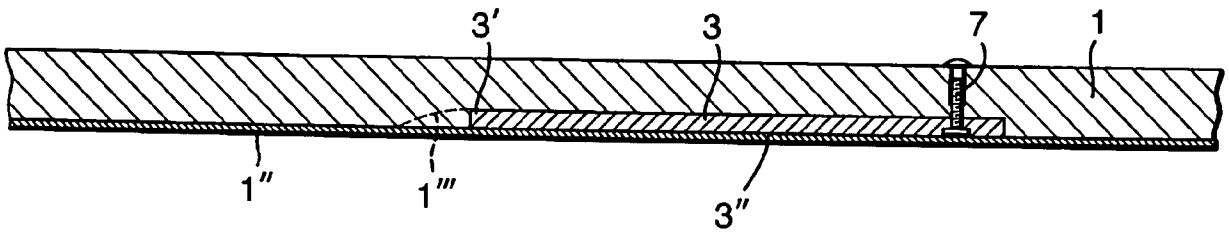
FIG. 5 shows a variant of the embodiment in FIG. 2.
Figure 6:
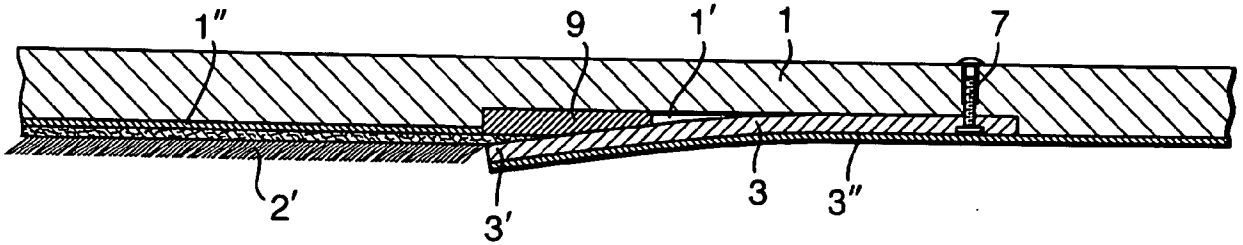
FIG. 6 shows a variant of the embodiment in FIG. 3.
Figure 7:
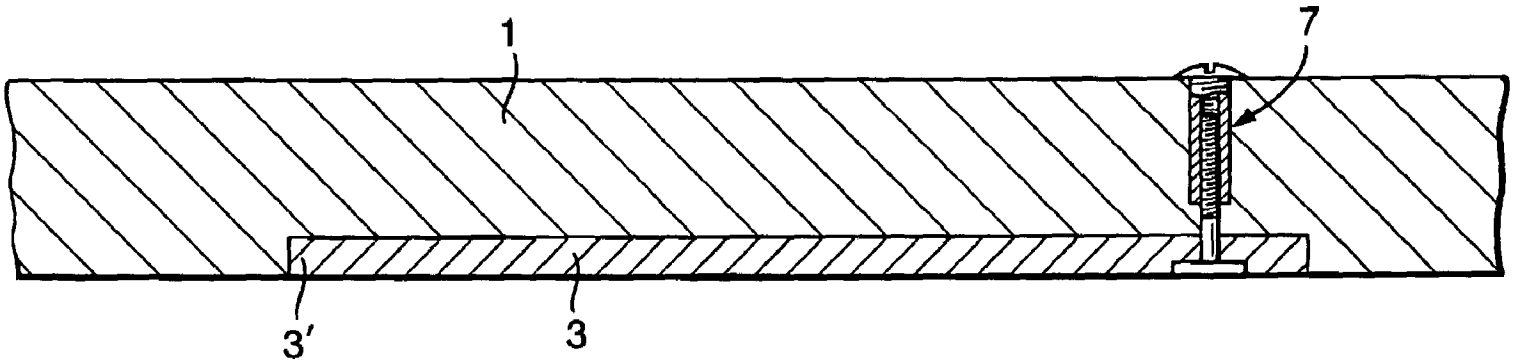
FIG. 7 is an enlarged sectional view of details of the embodiment shown in FIG. 5.
Figure 8:
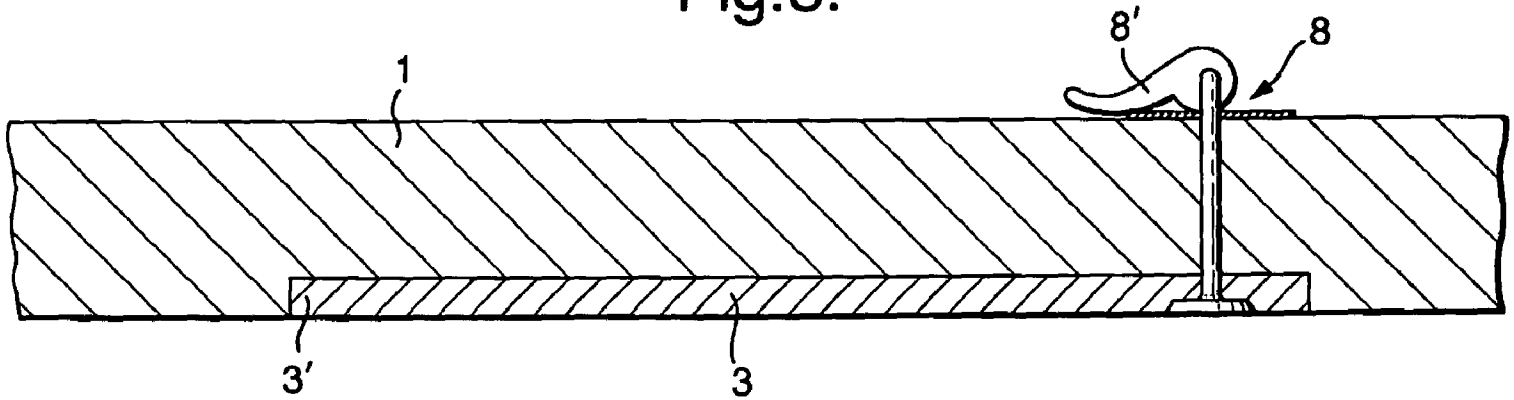
FIG. 8 shows a variant of the embodiment illustrated in FIG. 7.
Figure 9:
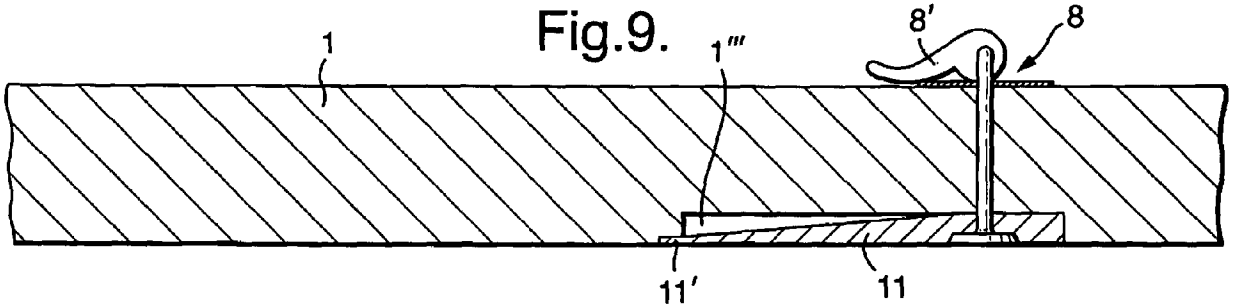
FIG. 9 shows a variant of the embodiment illustrated in FIG. 8.
Figure 10:
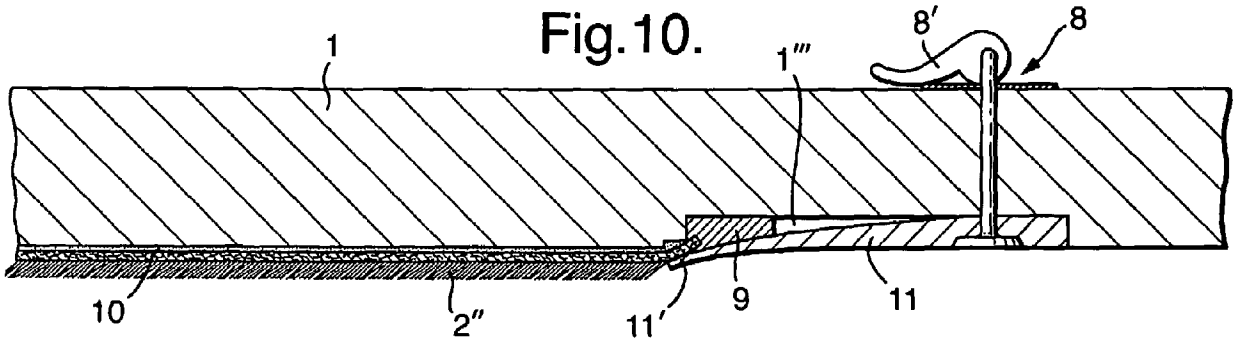
FIG. 10 shows the embodiment illustrated in FIG. 9 with a clamping plate in engagement with a skin.

FIG. 1 shows a ski 1 with a kick-enhancing covering 2, wherein the covering 2 at its forward part is held in place in a recess 1' in the ski by a clamping plate 3 that is secured by, e.g., at least one coarsely threaded screw 4 or screw-nut connection 5 as shown in FIGS. 5, 6 and 7, or is securable by means of a locking mechanism 8 as shown in FIGS. 8-10, preferably of the eccentric type. As an alternative, it is also possible to glue the clamping plate 3 to part of the adapted recess in the ski sole. On the underside of the ski there may be a glider covering 1" which is visible beyond the covering 2 and the plate 3, as indicated in FIGS. 4-6.

Figure 11:
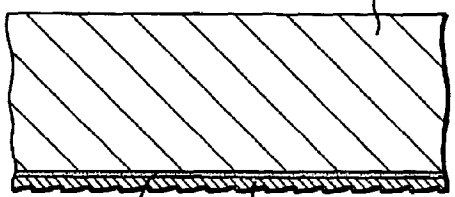
FIGS. 11 and 12 show in section and cross-section respectively a no-wax covering and a covering of the ski wax type affixed to a ski.
Figure 12:
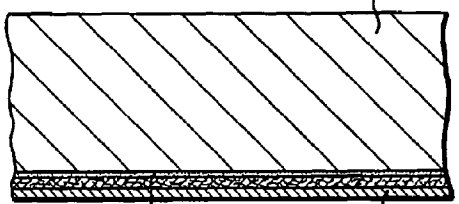

The covering shown in FIGS. 1-3, 4, 6 and 10 is preferably a skin 2", e.g., of the type that is in the form of a fur-like strip, preferably of synthetic fabric, wherein the fur may, for instance, have a structure resembling that of a sealskin or reindeer skin. Alternatively, the strip may be made wholly or partly of natural fur, for example, sealskin. As a further alternative, the strip could be made of a no-wax covering 2'" as indicated in FIG. 11, or a ski wax covering 2"" mounted on a band or strip, as indicated in FIG. 12. The covering 2 which is behind the plate 3 is glued to the underside of the ski, and it can be seen from FIGS. 1 and 4 that the covering in a preferred embodiment is found on a minor portion of the underside of the ski, preferably in that portion associated with the grip or kick zone of the ski, i.e., in an area under and slightly in front of and behind where a ski boot is fastened and presses down against the ski.

The clamping plate 3 is designed, when tilted upwards at a rear portion 3', to clamp with spring action the forward portion 2' of the band or strip which forms the covering 2 between the rear portion 3' and a portion 1' of the ski that is recessed relative to the ski sole. In this case, it may be appropriate to have a recess 1'" in the gliding surface of the ski at the rear edge of the plate 3 to allow the user a better grip on the clamping plate 3 in order to tilt the rear portion up. The plate 3, on the side facing away from the underside of the ski, may optionally be provided with barbs 3'" or engaging grooves so as to provide better engagement with that inserted into the portion 1', i.e., between the clamping plate and the ski.

If a locking mechanism 8, for example, of the eccentric type, is used, where the actual operating device 8' of the lock, e.g., a handle, is found on the upper side of the ski, there will be no need for such large forces to tilt up the rear portion 3' of the plate 3, as the operating device when temporarily released will release the plate 3 to some extent, so that the rear edge drops down slightly. This means that a somewhat more rigid plate can be used together with an eccentric lock than when a fixing screw or screws or a screw-nut fastening is used. Although it is not illustrated, it is of course possible to replace the screw-nut connection 7 with a conventional rivet-based connection (not shown). Alternatively, the plate 3 may be secured with an adhesive. Also conceivable is an eccentric locking mechanism replaced by a screw-nut connection or a ramp lock, wherein movement of an operating device causes an actuating element to move so as to gradually exert increasing pull on the clamping plate.

It may be expedient to allow the snow contacting side of the clamping plate 3 to be provided with a glider covering 3", as indicated in FIGS. 5 and 6, preferably a covering of the same type as the glider covering 1".

To ensure that the covering 2 formed by a band or strip does not easily slip out of engagement between the recess 1' in the ski 1 and the plate 3, the band or strip can be provided at its forward end 2' with a retaining piece 9 for placing in the recessed portion 1'. The retaining piece 9 will at least partly fill the recess 1' and prevent it from being filled with snow or ice, so that the plate 3 or 11 is impeded from moving back into the recess 1' in a satisfactory manner when there is no engagement with the covering 2.

The covering 2 in the form of a band or strip may have on the adhesive side 10, i.e., the side that is to face against the underside of the ski, a tear-off cover film (not shown) for uncovering the adhesive, so that the covering is easily attachable. The adhesive may be of a type that means it readily adheres or sticks to the underside of the ski, even if it is wet, e.g., because of melted snow, and so that the bond is good in the longitudinal direction of the ski, but less vertical on the underside of the ski, so that the covering can easily be stripped off for replacement.

As can be seen from FIGS. 9 and 10, it is possible to make the clamping plate 3 shorter, as indicated by way of example by a modified clamping plate 11 which cooperates with an eccentric locking mechanism 8. The clamping plate 11 has a rear covering-engagement portion 11'.

In use, the clamping plate 3 or 11 will form an at least almost smooth and edgeless transition from the forward gliding surface of the ski via the plate to the covering, for example, the skin. This improves the glide considerably compared with other known skin or covering fixing devices which are located under the ski, and with the solution according to the invention the steering and turning characteristics of the ski will also be better conserved than previously.

The thickness of the clamping plate is so dimensioned that its recessing into the ski sole does not affect the supporting structure of the ski to any appreciable extent.

If the user chooses not to have a kick-enhancing covering 2 on the underside of the ski, the clamping plate 3 or 11 will rest in the recess 1' or 1'". The ski will then be able to function as an ordinary ski without any covering, and can be waxed and used in the normal manner.

The plate 3 or 11 may optionally have a longitudinal groove aligned with the longitudinal groove of the ski, if there is one.

Compared with the standard long skins, the present solution will be lighter, attachment to the ski will be better and more secure, and the turning and gliding characteristics of the ski will be reduced far less than with a ski that is equipped with a long skin. Compared with short skins that are attached via straps and fittings around the ski, the present solution is superior as regards better turning and gliding characteristics of the ski. Compared with ordinary ski wax, a solution involving a fixed skin according to the present invention will give better grip, better adaptation to varying conditions, and a simpler way of removing the skin when necessary if a better glide is required.

Since the end of the plate 3 or 11 that faces towards the ski tip is, when fastened, always recessed, the gliding resistance in the direction of the skin will be reduced, whilst the forward edge of the skin 2" will not act as an edge. Thus, the gliding resistance which the forward edge of the skin would otherwise have given will not be present.

Although FIGS. 1 and 4 show a rectangular plate 3, this should of course not be regarded as anything other that a preferred, non-limiting example. Although the plate 3 or 11, at its forward edge or when a covering 2 is not secured, preferably is flush with the covering 1"on the ski, this will of course be preferable so as to ensure that the covering 3" is flush with the covering 1".

The plate 3 or 11 may be made of different types of materials, e.g., stainless spring steel, optionally with a glued, attached or sintered glider covering on the snow contact side. The plate may also be made of a partly stamped-out section of a longer plate that rests on the underside of the ski or is recessed into the underside of the ski.

The plate 3 or 11 may optionally be slightly curved at the screw fastening or where the plate is designed to be fastened to the ski via a locking mechanism and/or towards the rear edge of the plate, so that at its rear edge it thus presses against the ski and does not open when not used to secure a covering.

Although FIGS. 9 and 10 show a clamping plate having a cross-section that gradually decreases towards the rear, it will be understood that such a plate will usually be thin and even shorter in length, so that the plate in FIGS. 9 and 10 may have a uniform thickness.

Although it is shown in FIGS. 5-10 that the fastener, for example, a screw or bolt has a head portion in engagement with a hole and a recessed portion in the plate, it is of course conceivable that the fastener may instead be riveted or welded to the plate.

Figure 13:
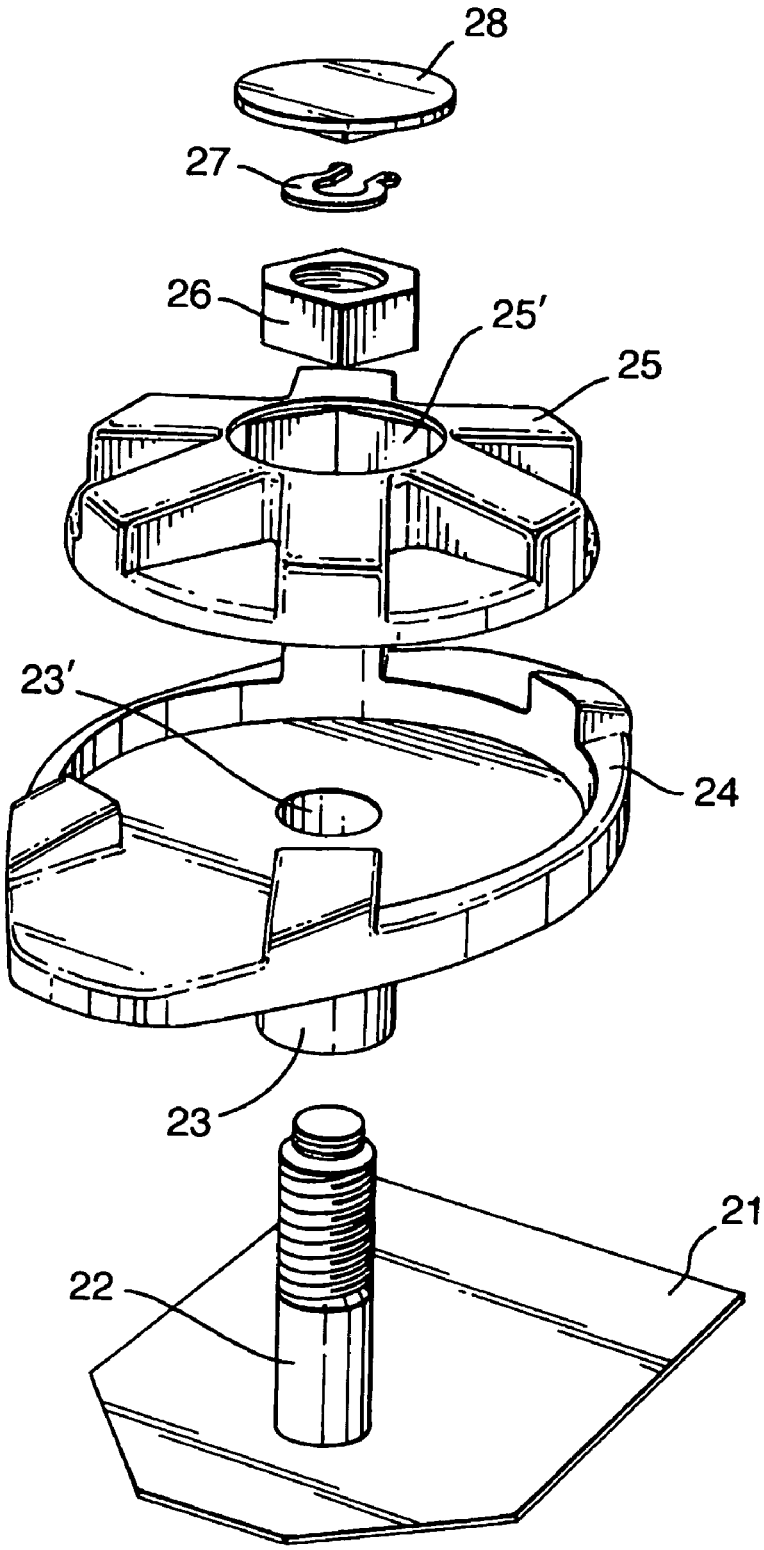
FIG. 13 is an exploded view of a modification of the device shown in FIG. 7.
Figure 14:
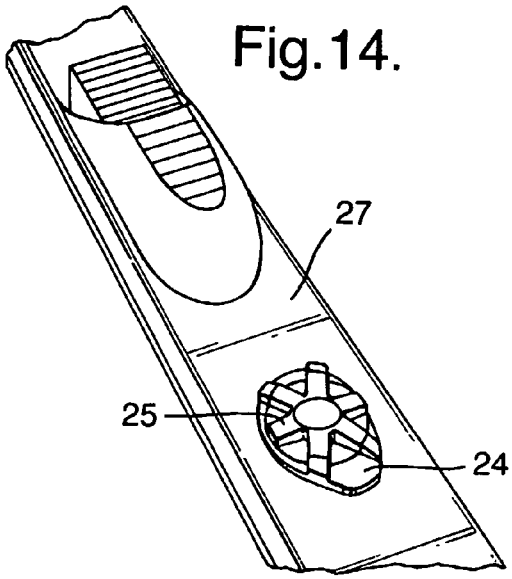
FIG. 14 shows the device in FIG. 13 mounted on a ski.
Figure 15:
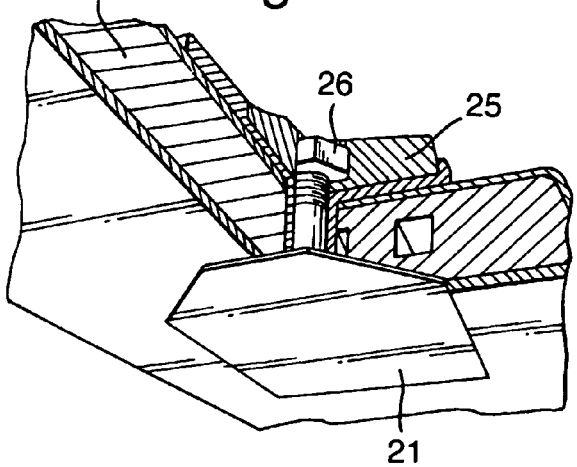
FIG. 15 shows the device shown in FIG. 13 seen from the underside of the ski with parts of the ski partly cut away.
Figure 16:
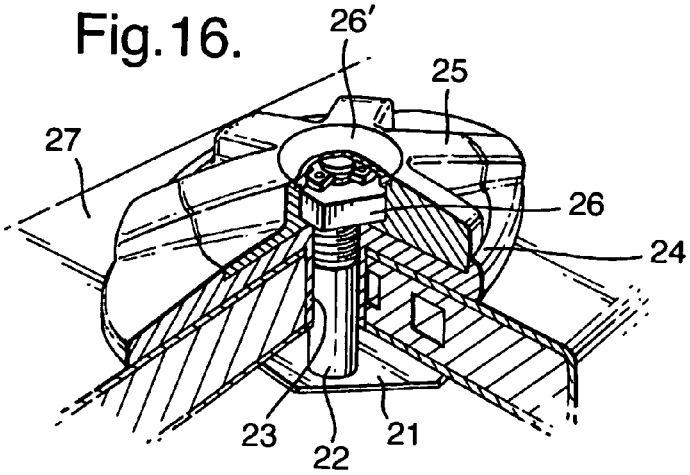
FIG. 16 is a perspective top view of the device illustrated in FIG. 13, with parts of the ski partly cut away.
Figure 17:
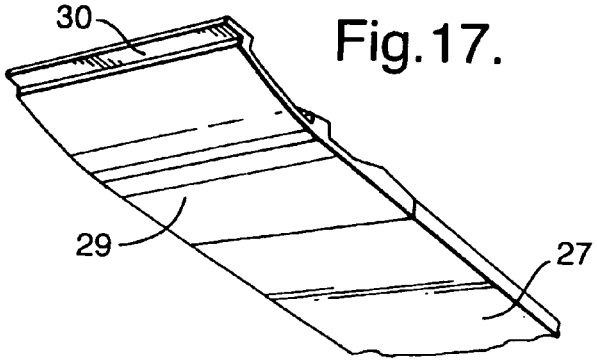
FIG. 17 shows a kick-enhancing covering equipped with a retaining piece for use with the device as shown in particular in FIG. 13.

The solution shown in FIGS. 13-17 is related to a modification of the solution shown in FIG. 7. As will be seen, fastened to a clamping plate 21 is a screw body 22 that extends up through a sleeve 23 and a hole 23 indicated in supporting washer 24. A tensioning wheel 25 is provided in which is placed a nut 26. The screw 22 is prevented from disengaging from the nut 26 by means of a clip 27. The reference numeral 28 denotes a covering cap for engagement with a recess 25 indicated on the part 25. The device illustrated in FIG. 13 is shown mounted on a ski 27 in FIGS. 14, 15 and 16. A kick-enhancing band or strip 28 is shown in more detail in FIG. 17 where this band or strip is fastened to a retaining piece 29 which at it forward portion is stepped 30. When this portion 30 passes into a recess in the ski sole, it will be held in place by the clamping plate 21 when tensioning is effected.

Figure 18:
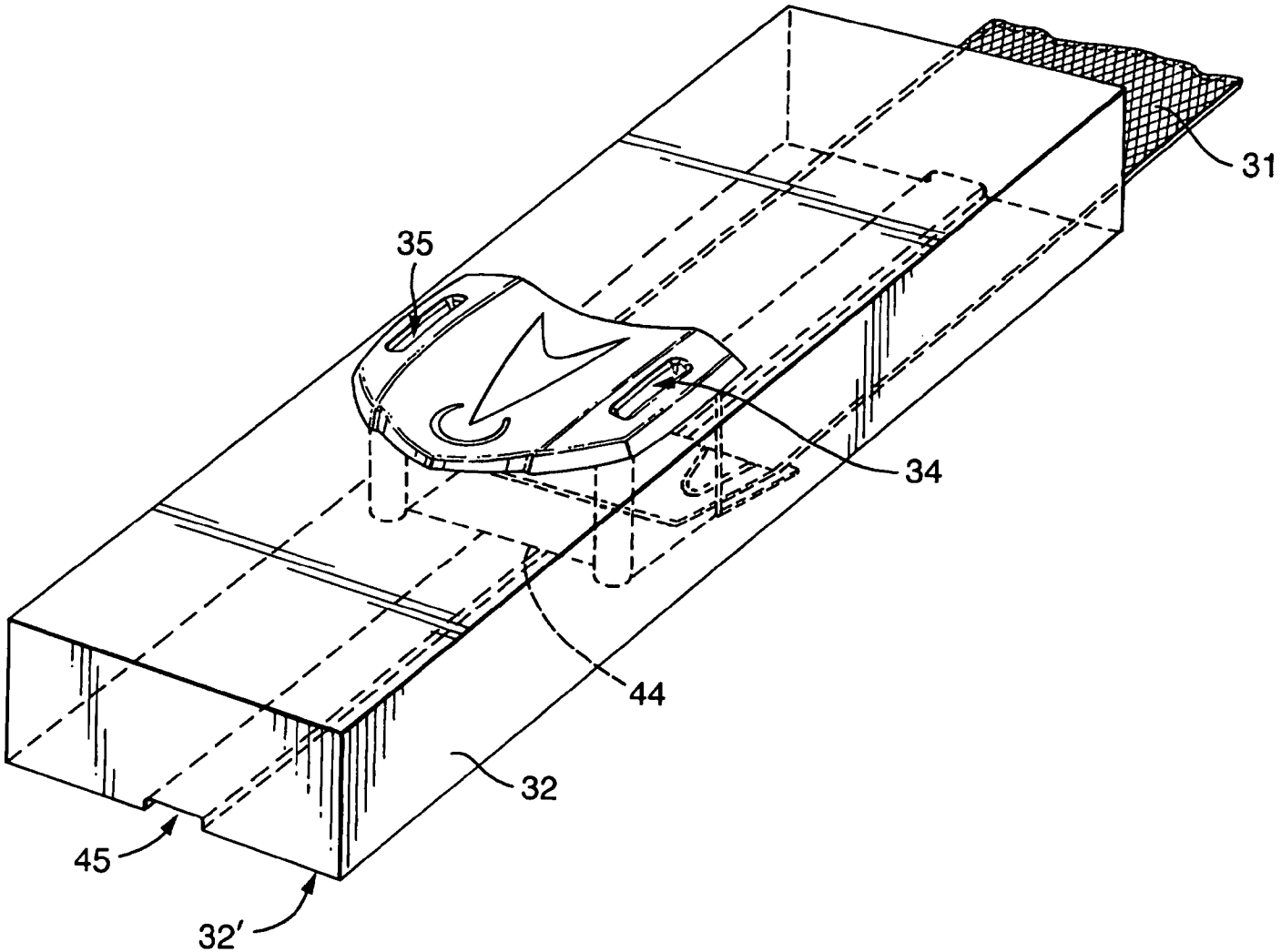
FIG. 18 shows another embodiment of the system and the device according to the invention in cooperation with a kick-enhancing covering, mounted on a ski.
Figure 19A:
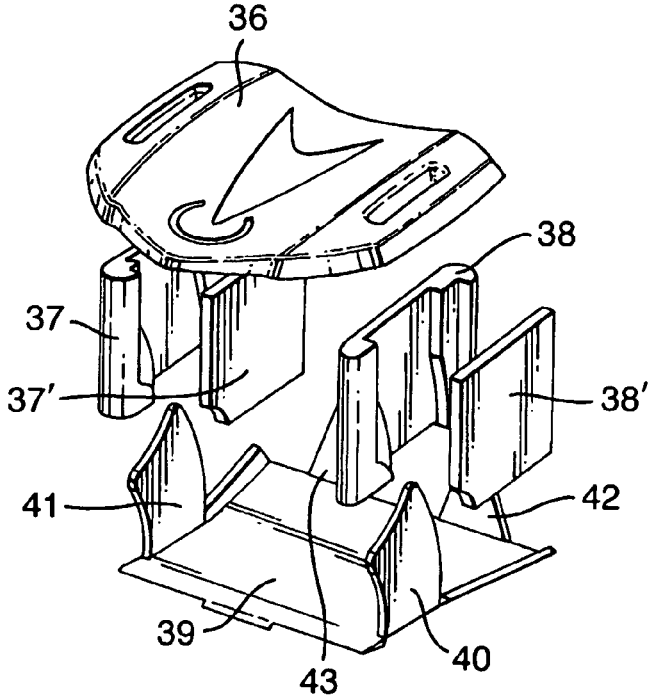
FIG. 19*a* is a top perspective view of an engagement block which is a part of the device shown in FIG. 18 together with a retaining piece for a kick-enhancing covering.
Figure 19B:
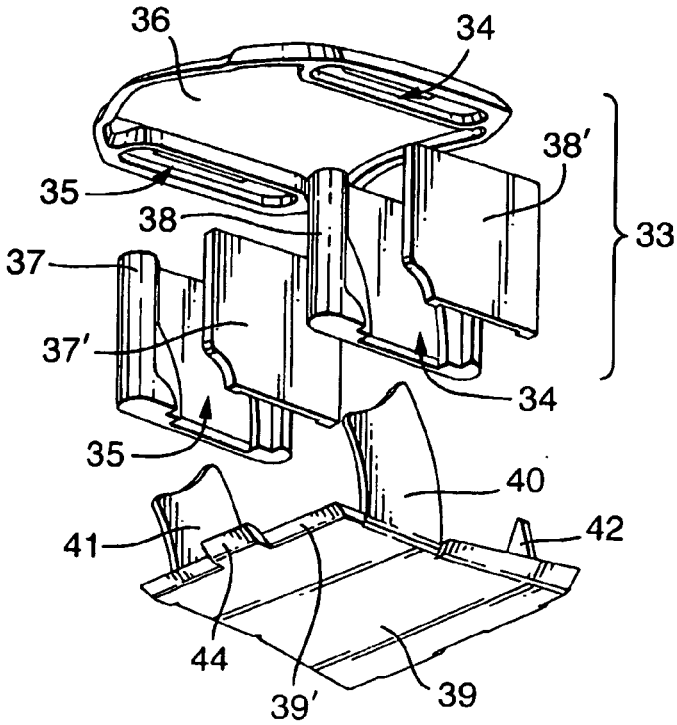
FIG. 19*b* shows the same as FIG. 19*a*, but seen in perspective from the underside.
Figure 20:
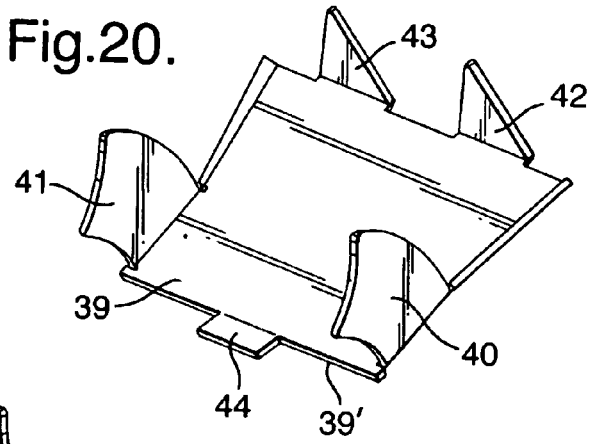
FIG. 20 shows one retaining piece for a kick-enhancing covering.
Figure 21:
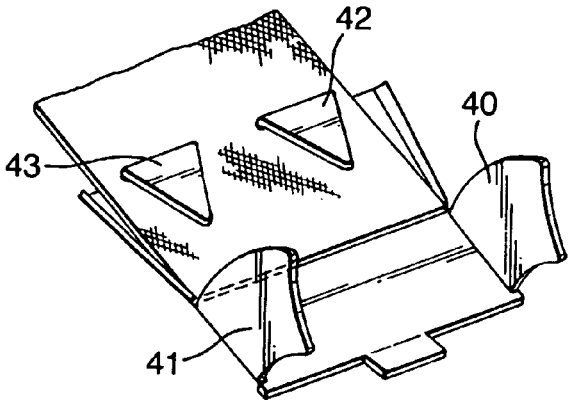
FIG. 21 is a perspective view of a kick-enhancing covering fixed to a retaining piece.

FIG. 18 shows another variant of the kick-enhancing system, wherein the system in this case also comprises a band or a strip 31 which on one face thereof is attachable to a portion of the ski sole by means of an adhesive, and which on the opposite face is equipped with a skin, a no-wax covering or a ski wax covering. In the ski 32 itself there is also mounted an engagement block 33 which has at least one engaging hole. However, in FIGS. 18, 19*a* and 19*b*, the engagement block is shown with two engaging holes 34, 35. The engagement block 33 in FIGS. 19*a* and 19*b* is shown with its parts separated so that it is easier to see how the engagement block is constructed. In the illustrated embodiment, the engagement block consists of a top piece 36 and two housing portions 37, 37' and 38, 38', wherein each housing portion 37, 37' and 38, 38' forms said engaging hole. As can be seen from FIGS. 19*a* and 19*b*, the housing portions 37 and 38 are identical and the housing portions 37' and 38' are identical. This reduces production costs substantially. It will be seen from FIGS. 19*a* and 19*b* in conjunction with that shown in FIG. 18 that the two holes 34, 35 are through holes and are thus self-draining. A retaining piece 39 is provided, and in the illustrated embodiment it is equipped with two upright fastening lugs 40, 41 designed to be passed into respective holes 34, 35. The said engaging holes 34, 35 and the respective fastening lugs each have at least one curved portion. This means that the fastening lugs 40, 41 must be inserted into the engaging holes 34, 35 with a tilting motion, so that when the retaining piece 39 is almost flush with the underside 32' of the ski 32, the lugs 40, 41 will not be able to disengage from or be pulled directly out of the holes 34, 35. It will be seen that the said curved portions are designed to extend in a curve from the underside of the ski upwards and in the forward direction of the ski. This can be seen most clearly in FIG. 19*b* and in FIG. 23. This is important for the harmonisation of the opening and closing movement with the tear-off movement for the skin itself.

Figure 23:
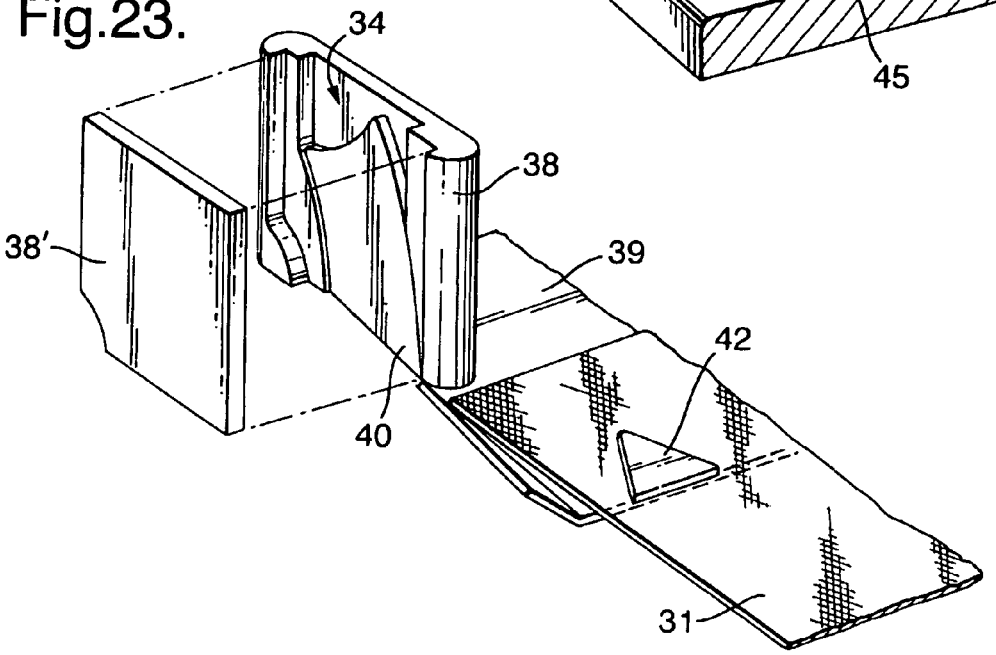
FIG. 23 shows how the retaining piece engages with a hole in the engagement block.

The retaining piece 39 will also be equipped with, for example, fastening hooks 42, 43 designed to be pressed through the band or strip 31 and bent down, as shown in FIG. 23 to secure the band or strip to the retaining piece 39. Alternatively, it is conceivable that the band or strip 31 may be glued or riveted to the retaining piece 39.

Figure 22:
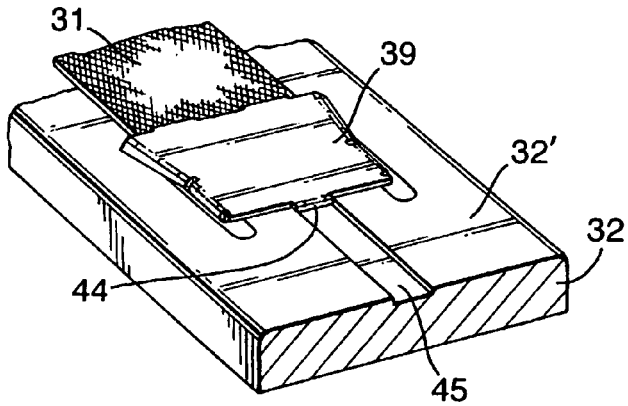
FIG. 22 shows a kick-enhancing covering with retaining piece inserted in an engagement block on a ski.

It may be advantageous to allow the forward edge 39' of the retaining piece 39 to be provided with a tab 44 that is intended to pass into the central groove 45 on the underside 32' of the ski 32, as shown clearly in FIG. 22 and indicated in FIG. 18. As can be seen from FIG. 19*b*, this will prevent snow in the groove 45 from penetrating under the retaining piece 39 on movement of the ski. It would also be advantageous to allow the forward edge 39' of the retaining piece 39 to be chamfered, as shown in FIG. 19*b*. The forward edge 39' may optionally be made to engage with a transverse groove 46 in the actual ski sole. This transverse groove may optionally have an undercut or chamfered portion.

An important aspect of the solution shown in FIGS. 18-23 is that the retaining piece 39 should not project perpendicularly from the underside of the ski 32' any more than the band or strip 31. Therefore, the fastening hooks 42, 43 which fasten the band or strip to the retaining piece 39 are placed at the rear edge thereof and so formed that when clamped down they cut slightly into the band or strip.

On engagement with the block 36, the fastening lugs 40, 41 are located with their faces in the longitudinal direction of the ski so as not to break the bearing structures of the ski, i.e., the longitudinal fibres. Such longitudinal engagement in the ski will cause insignificant weakening of the mechanical strength of the ski.

In most of the solutions illustrated, a retaining piece is used at one end of the band or strip to more easily define the forward end of the band or strip and more easily hold it in place.

If the skier chooses not to have a kick-enhancing covering on the underside of the ski, the clamping plate 21 will remain in its recess in the ski sole. When the solution shown in FIGS. 18-23 is used, no part of the engagement block will project from the underside or sole of the ski. When the retaining piece and thus the kick-enhancing covering are not employed, it will only be the two holes 34, 35 that are visible, but these are very narrow and will not have any effect on the properties of the ski. Thus, when a kick-enhancing covering with a retaining piece is not employed, the ski will be able to function as an ordinary ski without a covering, and can be waxed and used in a normal manner.

Figure 24:
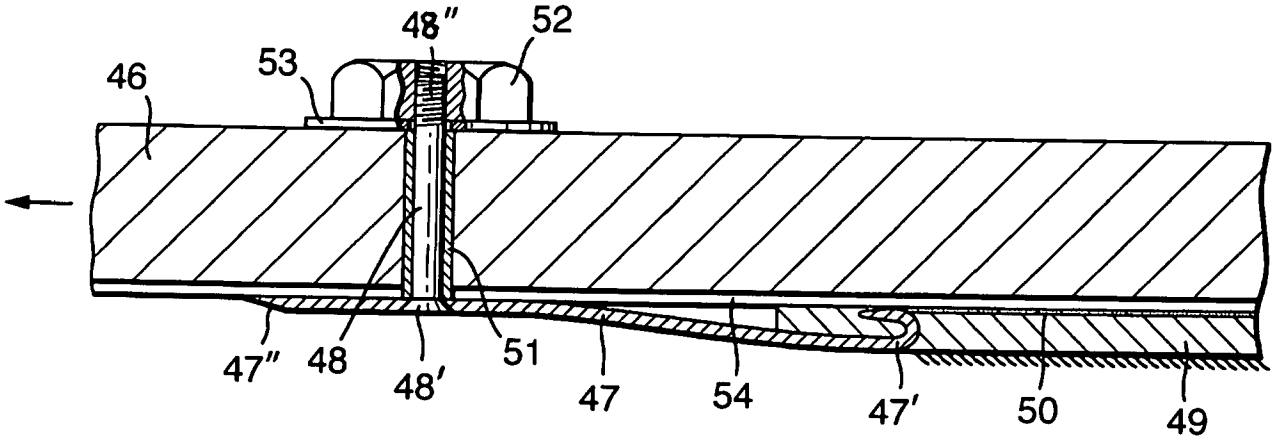
FIG. 24 shows a modification of the system depicted in FIGS. 7-9 and 13-17, seen in a longitudinal section through the ski.
Figure 25:
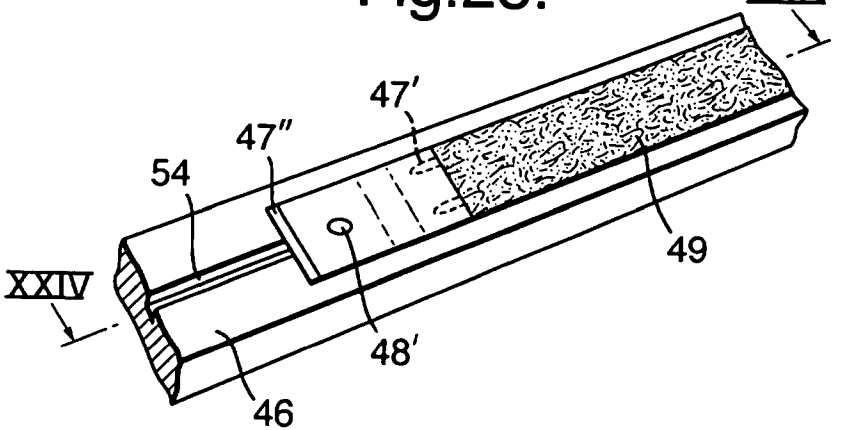
FIG. 25 shows the embodiment depicted in FIG. 24, seen in perspective from the underside of the ski.

FIGS. 24 and 25 show a ski 49 where the arrow in FIG. 24 points in the direction of the ski tip (not shown). A fixing plate 47 is provided to secure, with the aid of hooks 47' on the fixing plate 47, a kick-enhancing band or strip 49, where the hooks grip a forward portion of the band or strip. The plate 47 has a forward area 47" which is preferably chamfered. The plate 47 cooperates with at least one bolt 48 that is fastened by a head portion 48' to the plate 47 and which extends through the ski 46 to its upper side via a bushing or sleeve 51. An upper portion of the bolt 48 has a threaded portion 48" for cooperation with a tightening nut 52. Advantageously, a washer 53 is placed between the surface of the ski and the nut. The reference numeral 50 indicates an adhesive for attaching the skin 49 in the form of said band or strip to the underside of the ski. The reference numeral 54 indicates the conventional groove found on skis. If the fixing plate 47 with associated skin 49 and fixing nut is not in use, the ski could be used as an ordinary ski, as there will then only be a small hole through the ski where the bushing or sleeve 51 is located.

The invention claimed is:

1. A ski including a kick-enhancing covering, the ski comprising:

an upper surface having a portion to which a ski boot is to be fastened;

an underside surface including a kick zone opposite to the portion to which the ski boot is fastened, and extending slightly in front of and slightly behind the portion to which the ski boot is fastened;

a recess in the underside surface forward of the kick zone;

a fixing plate disposed in the recess and secured in a forward portion thereof; and a band or strip equipped with a skin, ski wax or waxless kick-enhancing covering limited to the kick zone;

the band or strip extending forward and being retained in the recess between a rearward portion of the fixing plate and the underside surface of the ski.

2. A ski as claimed in claim 1, wherein the fixing plate is secured to the ski by means of an eccentric locking mechanism or adhesive, or is fastened to the ski with at least one screw, a screw-nut connection, or rivet arrangement.

3. A ski as claimed in claim 1, wherein the fixing plate is provided externally with a glider covering.

4. A device for affixing to a ski a band or strip equipped with a kick-enhancing covering and comprising an engagement block mountable in the ski which comprises:

a top portion, at least one housing portion which has at least one engaging hole therethrough, and a retaining piece with at least one engaging lug insertable into said engaging hole to receive and form retaining engagement with the at least one housing portion, the retaining piece including means for fastening thereto a forward portion of the band or strip.

5. A device as claimed in claim 4, wherein the engaging hole is so dimensioned that when the engagement block is mounted in the ski, the hole extends through the ski from an underside to an upper side.

6. A device as claimed in claim 4, wherein the engagement block has two engaging holes for engagement with engaging lugs on retaining pieces.

7. A device as claimed in claim 5, wherein said engaging hole and engaging lug each have at least one curved portion.

8. A device as claimed in claim 7, wherein when the engagement block is mounted on the ski, the curved portion of the engaging hole extends in a curve upwards from an underside of the ski and in a forward direction of the ski.

9. A device as claimed in claim 4, wherein the engagement block has at least one housing portion which forms said hole, said housing portion, when the engagement block is mounted in the ski, extending from an upper side of the ski through the ski to an underside.

10. A fitting for use with a ski as claimed in claim 1, wherein the fitting comprises a retaining piece having means for engagement with an end portion of a band or strip which has a kick-enhancing covering, and the retaining piece has at least one bolt for insertion into a fixing hole in a ski, the bolt having an end portion designed for locking the retaining piece to the ski.

11. A fitting for use with a device as claimed in claim 4, the fitting comprising a retaining piece having a means designed for engagement with an end portion of a band or strip which has a kick-enhancing covering, and the retaining piece having two curved engaging lugs designed for insertion into and engagement with an engagement block mountable in a ski.

12. A fitting as claimed in claim 10, wherein said means comprises at least two bendable fixing hooks arranged at the rear edge of the retaining piece, designed to penetrate through the band or strip.

* * * * *